US007051566B2

(12) United States Patent
Baulier et al.

(10) Patent No.: US 7,051,566 B2
(45) Date of Patent: May 30, 2006

(54) METHOD FOR PERFORMING A 180 DEGREE HEM AND APPARATUS FOR PERFORMING THE SAME

(75) Inventors: Dominique Baulier, St. Clair Beach (CA); Darius Gheorghita, Belle River (CA); Gabor Sztvorecz, Windsor (CA)

(73) Assignee: Valiant Corporation, Windsor (CA)

( * ) Notice: Subject to any disclaimer, the term of this patent is extended or adjusted under 35 U.S.C. 154(b) by 0 days.

(21) Appl. No.: 10/883,546

(22) Filed: Jul. 1, 2004

(65) Prior Publication Data

US 2006/0000255 A1 Jan. 5, 2006

(51) Int. Cl.
*B21D 39/02* (2006.01)

(52) U.S. Cl. ..... 72/306; 29/243.58

(58) Field of Classification Search ..... 72/312–315, 72/306, 386; 29/243.58, 243.57
See application file for complete search history.

(56) References Cited

U.S. PATENT DOCUMENTS

| | | | | |
|---|---|---|---|---|
| 5,740,691 A | * | 4/1998 | Kovarovic et al. | 72/306 |
| 6,035,504 A | | 3/2000 | Gorgen | 29/243.5 |

FOREIGN PATENT DOCUMENTS

| | | | |
|---|---|---|---|
| DE | 4445579 | | 2/1996 |
| DE | 20116187 | | 1/2003 |
| JP | 7-9040 | * | 1/1995 |
| JP | 7-88567 | * | 4/1995 |
| JP | 2001-205365 | * | 7/2001 |
| JP | 2001 239323 | | 9/2001 |
| JP | 2003-181547 | * | 7/2003 |

* cited by examiner

*Primary Examiner*—Daniel C. Crane
(74) *Attorney, Agent, or Firm*—Gifford, Krass, Groh, Sprinkle, Anderson & Citkowski, P.C.

(57) ABSTRACT

A hemming method for performing a 180 degree hem between an inner panel and outer metal panel. A curvilinear prehemming tool is then moved in a direction substantially parallel to the plane of the inner and outer panels so that the prehemming tool contacts a protruding coupon on the outer panel and creates a bend line in the coupon at a position spaced outwardly from the outer edge of the inner panel. Thereafter, a final hemming tool moves relative to the panels in a direction substantially parallel to the original plane of the inner and outer panels. This final hemming tool includes a first curvilinear surface which initially contacts the coupon and rolls the coupon such that the edge of the coupon contacts the inner panel. Thereafter, a generally planar wedge section of the final hemming tool contacts the coupon and compresses the coupon against the inner panel thus completing the hemming operation.

20 Claims, 7 Drawing Sheets

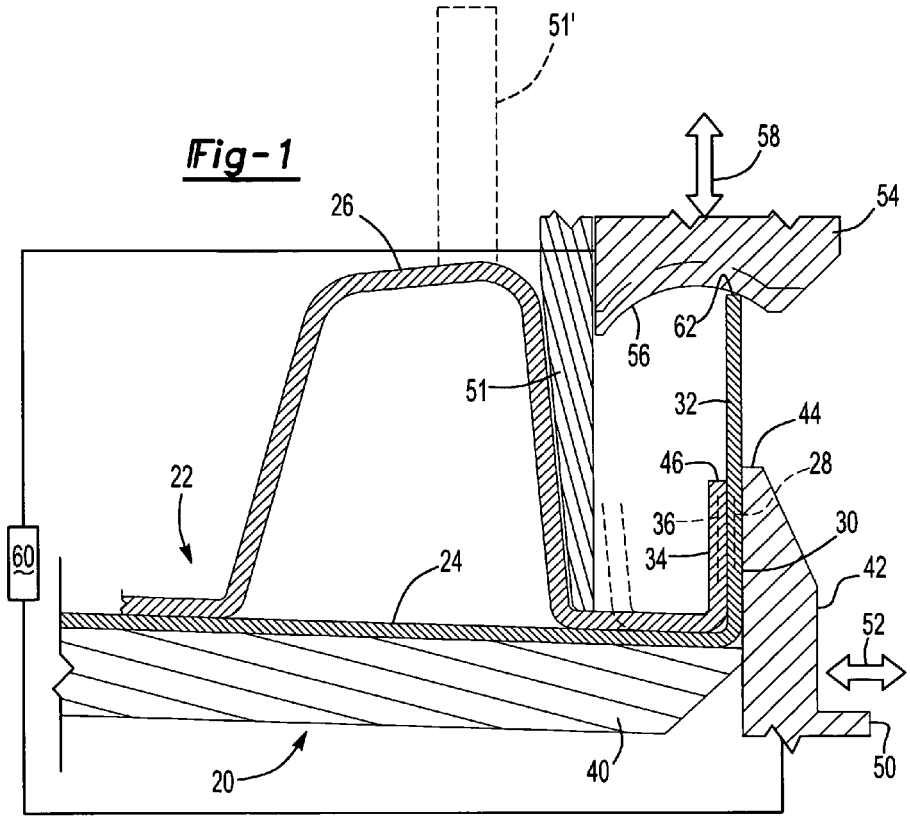
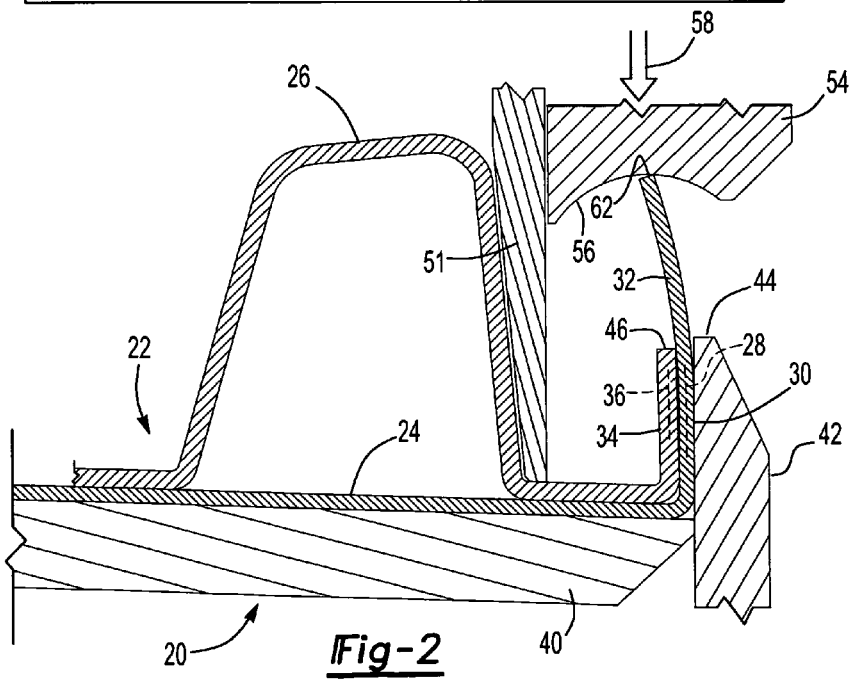
Fig-2

METHOD FOR PERFORMING A 180 DEGREE HEM AND APPARATUS FOR PERFORMING THE SAME

BACKGROUND OF THE INVENTION

I. Field of the Invention

The present invention relates generally to hemming methods and hemming machines of the type used in the automotive industry to hem a sheet metal panel over an inner panel to form a rigid assembly.

II. Description of Related Art

In the automotive industry, hemming machines are conventionally used to attach two metal panels together. These metal panels include, for example, the metal panels to form the automotive vehicle hood, door panels, and the like.

In the previously known hemming methods, a substantially 90 degree flange is first formed on an outer panel. Thereafter, an inner panel is positioned upon the outer panel so that an outer edge of the inner panel lies adjacent the bend line for the flange.

A prehemming tool then contacts and compresses the flange such that the flange overlies the outer edge of the inner panel. Typically, the prehemming tool bends the flange at a 45 degree angle relative to the plane of the outer edge portion of the inner panel.

Thereafter, a generally planar final hemming tool compresses the prehemmed flange against the inner panel so that the outer edge portion of the inner panel is sandwiched in between the flange and the outer panel thus securing the inner and outer panels together.

The previously known hemming methods and the machines for performing those methods, however, suffer from a number of disadvantages. One disadvantage of these previously known hemming methods and the machines for performing those methods is that three distinct machining operations are necessary to complete the hemming operation. These three machining operations include a flanging operation for initially forming the flange on the outer panel, a prehemming operation to bend the outer panel flange so that it overlies the outer edge portion of the inner panel and, finally, the final hemming operation to compress the flange against the outer edge portion of the inner panel. The necessity of three distinguishing operations inherently increases the machining cost for the final body panel. Furthermore, in many cases a separate flanging machine is used to form the flange on the outer body panel while a different machine performs both the prehem and final hem operations. The requirement to have two distinct machines, i.e. a flanging machine and a hemming machine, further increases the overall manufacturing cost of the body panel.

A still further disadvantage of these previously known hemming methods and the machines for performing these methods is that a relatively large amount of power is required during the final hemming operation to adequately compress the flange against the inner panel. The actuators as well as the components associated with the actuators to achieve this high power during the final hemming operation also increase the overall cost of the hemming machines, their installation cost as well as their energy consumption.

A still further disadvantage of these previously known hemming methods and the machines for performing those methods is that the relative movement between the prehemming and final hemming tools and the body panel assembly is in a direction generally perpendicular to the plane of the body panels. In some applications, however, there is simply insufficient room in the direction perpendicular to the plane of the inner panel to accommodate such movement of the prehemming and final hemming tools. For example, in an automotive roof opening, such as a moon roof or sun roof, a portion of the inner body panel is typically positioned close to and immediately beside the outer edge portion of the inner body panel. In this situation, the conventional prehemming and final hemming methods for forming the hem cannot be used.

In order to overcome this limitation of the conventional hemming methods, one specialized hemming method and apparatus for performing the hem particularly suited for roof openings in automotive vehicles is disclosed in U.S. Pat. No. 6,035,504. In the '504 patent, the inner and outer panels are arranged so that the coupon on the outer panel protrudes outwardly from the outer edge of the inner panel. The flanging side of the tool then first forms a substantially 90 degree flange on the coupon by deflecting the coupon laterally with respect to the inner body panel which is maintained in position by a back-up steel, and so that the outer body panel forms a bend line at its contact point with the inner body panel. Following the flanging operation, the prehemming side of the tool contacts the flange and bends the flange such that the flange overlies and is in close proximity to the outer body portion on the inner body panel. Finally, following the prehemming operation, the final hemming side of the tool compresses the flange against the inner body panel thus completing the hemming operation.

The main disadvantage of this tool is that a large gap is required to move the back-up steel into position to firmly maintain the upstanding inner flange when forming the initial flange on the outer coupon.

One disadvantage of this previously known hemming method, however, is that the flange on the outer body panel is in contact with the outer edge of the inner body panel following the flanging operation. Consequently, during the subsequent prehemming and hemming operations, a compression load is imposed on the outer edge of the inner body panel during the prehemming operation. When this occurs, distortion of the inner body panel and/or distortion of the outer body panel can result.

A still further disadvantage of this previously known hemming method is that the final hemming tool, during the final hemming operation, compresses the flange against the inner body panel by movement of the final hemming tool in a direction generally perpendicular to the inner body panel thus compressing the flange against the inner body panel. Performing a satisfactory hem using perpendicular compression during the final hemming operation, however, requires a relatively large amount of power for the hemming machine.

SUMMARY OF THE PRESENT INVENTION

The present invention provides a hemming method, as well as a machine for performing the hemming method, which overcomes the above-mentioned disadvantages of the previously known hemming methods and machines for hemming two body panels together and which is particularly suited for hemming panels to form roof openings, such as a moon roof or sun roof, on an automotive vehicle. Furthermore, as will become hereafter apparent, a 180 degree hem is performed using only two machining operations, i.e. a prehemming operation and a final hemming operation, and without the need for performing a flanging operation.

In brief, in the hemming method of the present invention, an inner and outer panel are first arranged so that the outer edge portions of both the inner and outer panels flatly abut against each other and also so that a portion of the outer body panel protrudes outwardly from the outer edge of the inner body panel thus forming a coupon. The outer panel and its coupon generally lie in a plane that is parallel to the plane of the outer edge portion of the inner body panel. Furthermore, in the preferred embodiment of the invention, the outer body panel comprises a roof panel for an automotive vehicle having an aperture opening for a sun roof or a moon roof while the inner body panel is a frame reinforcing the roof panel around its aperture, and supporting the sun roof or moon roof.

With the inner and outer body panels positioned as thus described, a prehemming tool having a curvilinear surface and the body panels are moved relative to each other in a direction substantially parallel to the plane of the coupon. In doing so, the curvilinear surface of the prehemming tool first contacts the outermost edge of the coupon thus initially deflecting the coupon. Further movement of the prehemming tool and the body panels relative to each other causes the coupon to buckle along a bend line in the direction imposed by the initial deflection, and at a position spaced outwardly from the outer edge of the inner body panel. Following completion of the prehemming operation, the coupon extends transversely with respect to the original plane of the outer body panels and so that the coupon extends across the outermost edge of the inner body panel.

Thereafter, the body panels with the prehemmed coupon are then moved relative to a final hemming tool in a direction generally parallel to the plane of the original inner and outer body panel outer edge portions. This final hemming tool includes a first curvilinear portion which initially contacts the coupon. Following contact between the curvilinear portion of the final hemming tool and the coupon, the final hemming tool moves the coupon toward the inner body panel as the coupon rolls along the curvilinear portion of the final hemming tool. At the time the end of the curvilinear portion of the final hemming tool abuts against the coupon, the free edge of the coupon abuts against the inner body panel while a loop is formed at a position spaced outwardly from the free edge of the inner body panel.

The final hemming tool also includes a linear wedge portion immediately adjacent the curvilinear portion. Consequently, during the continued movement of the body panel assembly relative to the final hemming tool, the planar wedge portion of the final hemming tool slides along the loop formed by the coupon thus compressing the coupon toward the inner body panel and completing the hemming operation by achieving an almost flat hem. At the end of the hemming operation, the loop formed by the coupon is flattened and spaced outwardly from the free edge of the inner body panel.

Consequently, unlike the previously known devices, the hemming method of the present invention performs a 180 degree hem using solely two machining operations, namely the prehem operation and the final hem operation. Consequently, the previously known requirement for a flanging operation, with its constraint of inserting a back-up tool, is completely eliminated.

A still further advantage of the present invention is that, since the prehemming operation forms a bend line on the coupon at a position spaced outwardly from the free edge of the inner body panel during the prehemming operation, no longitudinal force is imposed upon the inner body panel during either the prehemming or final hemming operation. This, in turn, eliminates the previously known distortion of the inner body panel and/or outer body panel during the overall hemming operation.

A still further advantage of the hemming operation of the present invention is that, since the relative movement between the body panel and the hemming tools is substantially in a direction parallel to the plane of the inner and outer body panel edge portions, the hemming method can be practiced in limited space applications, such as the frame for a moon roof or sun roof on an automotive vehicle.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is a partial fragmentary sectional view illustrating an initial step of the prehemming method of the present invention;

FIG. 2 is a view similar to FIG. 1, but illustrating the initiation of the prehemming operation;

DETAILED DESCRIPTION OF PREFERRED EMBODIMENTS OF THE PRESENT INVENTION

Figure 3:
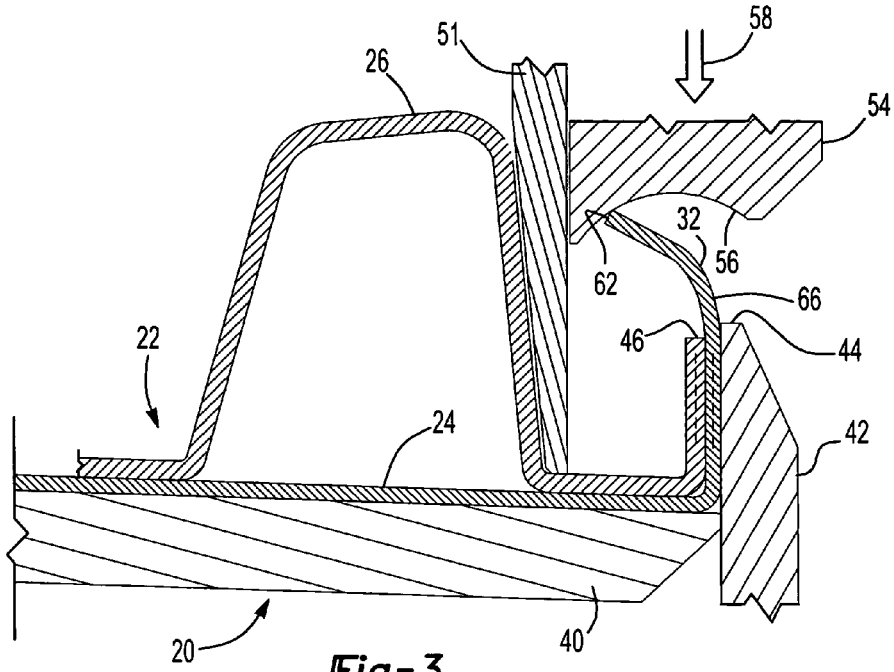
FIG. 3 is a view similar to FIG. 2, but illustrating the prehemming operation approximately half completed.

With reference first to FIG. 1, a preferred embodiment of the hemming method, as well as an apparatus 20 to perform the hemming method, is illustrated for hemming a body panel assembly 22 together. The body panel assembly 22 includes both an outer body panel 24 as well as an inner body panel 26. Furthermore, the body panel assembly 22 is illustrated as a body panel assembly for a sun roof or moon roof of an automotive vehicle in which the outer body panel 24 is the roof of the vehicle while the inner body panel 26 comprises the frame for the sun roof or moon roof. It will be understood, however, that the body panel assembly 22 illustrated in FIG. 1 is by way of illustration only and that the hemming method of the present invention may be used to hem body panel assemblies together of any manner or configuration.

Still referring to FIG. 1, the outer body panel 24 includes an outer edge portion 28 which lies in a predetermined plane 30 as well as a coupon 32 which protrudes outwardly and is coplanar with the outer edge portion 28 of the outer body panel 24. The inner body panel 26 also includes an outer edge portion 34 which lies in a plane 36 which is parallel to the plane 30 of the outer edge portion 28 of the outer panel 24.

The outer body panel 24 is supported on a nest 40 while the inner body panel 26 is positioned upon and supported by the outer body panel 24. Furthermore, with the inner body panel 26 positioned on the outer body panel 24 as shown in FIG. 1, the outer edge portions 28 and 34 of the outer panel 24 and inner panel 26, respectively, flatly abut against each other.

With the body panels 24 and 26 supported on the nest 40 as thus far described, an anvil 42 abuts against and supports the outer surface of the outer edge portion 28 of the outer panel 24. In doing so, the outer edge portion 28 of the outer panel 24 is sandwiched in between the anvil 42 and the outer edge portion 34 of the inner panel 26. An upper edge 44 of the anvil 42 also protrudes slightly above a free edge 46 of the inner panel outer edge portion 34.

The anvil 42 and nest 40 are all mounted in any conventional fashion to a frame 50, illustrated only diagrammatically. Furthermore, the anvil 42 is preferably movable in the direction of arrow 52 relative to the frame 50 to facilitate loading and unloading of the body panels 24 and 26 onto the nest 40. Any such movement of the anvil 42, however, would be minor and is not critical.

In order to prevent movement between the body panels 24 and 26 during the hemming operation, a hold down 51 engages the inner body panel 26 and effectively clamps the inner body panel 26 against the outer body panel 24. The hold down 51 is illustrated in FIG. 1 as contacting the outer body panel 24 closely adjacent the nest 40. Optionally, however, the hold down 51 may contact the inner body panel 26 at any convenient location, such as illustrated at 51'.

Figure 9:
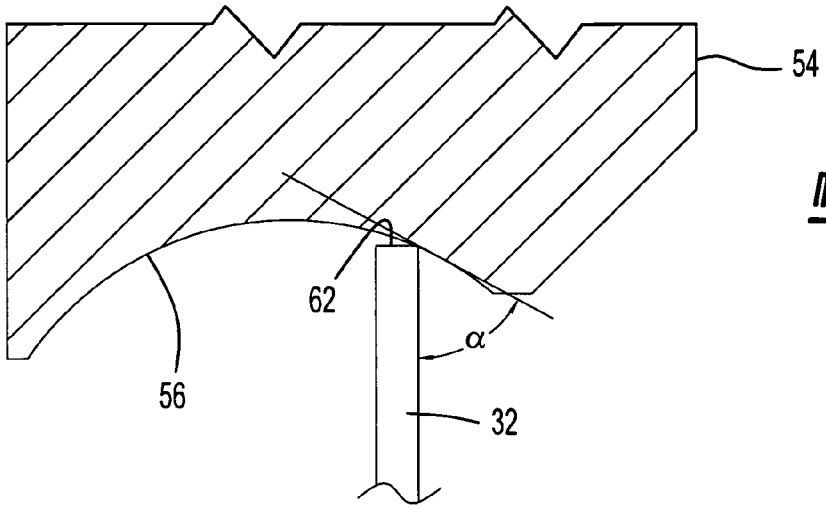
FIG. 9 is an enlarged view illustrating the prehemming tool.

With reference now to FIGS. 1 and 9, in order to perform the hemming operation of the present invention, a prehemming tool 54 includes a curvilinear surface 56. The curvilinear surface 56 is aligned with the coupon 32. Furthermore, the nest 40 and prehemming tool 54 are movable relative to each other in the direction indicated by arrow 58 which is substantially parallel to the plane 30 of the outer panel outer edge portion 28.

It will be understood, of course, that it is only important that the prehemming tool 54 and nest 40 move relative to each other along the direction of the arrow 58 and it is irrelevant whether the nest 40 or the prehemming tool 54, or both, move in the direction of arrow 58. Any conventional actuator 60, illustrated only diagrammatically, may be used to effect this relative movement between the nest 40 and prehemming tool 54. Furthermore, it is not necessary that the prehemming tool 54 and nest 40 move exactly parallel with respect to the plane 30 of the inner panel outer edge portion 28. Rather, it is only necessary that this movement be substantially, i.e. within 15 degrees, of the plane 30 of the outer panel outer edge portion 28.

As best shown in FIG. 9, at the initiation of the prehemming operation, the curvilinear surface 56 of the prehemming tool 54 contacts the outermost or free edge 62 at an attack angle $\alpha$. This angle $\alpha$, furthermore, is preferably within the range of 50–70 degrees and represents the tangent of the curvilinear surface 56 of the prehemming tool 54 relative to the plane of the coupon 32.

With reference now to FIG. 2, as the nest 40 and prehemming tool continue through the prehemming operation, the prehemming tool 54 initially deflects the coupon 32 as shown in FIG. 2. At this time, the free edge 62 of the coupon 32 slides along the curvilinear surface 56 of the prehemming tool 54.

With reference now to FIG. 3, as the prehemming operation continues, the prehemming tool 54 and nest continue to move towards each other causing the outer edge 62 of the coupon 32 to slide along the curvilinear surface 56 of the prehemming tool 54. However, as shown in FIG. 3, the coupon 32 begins to buckle at an area 66 that is spaced outwardly from the free edge 46 of the inner panel 26. Furthermore, since the upper edge 44 of the anvil 42 protrudes above the free edge 46 of the inner panel 26, the anvil 42 ensures that the outer panel will buckle along a line spaced outwardly from the free edge 46 of the inner panel 26 without any recoil over the upper edge 44.

Figure 4:
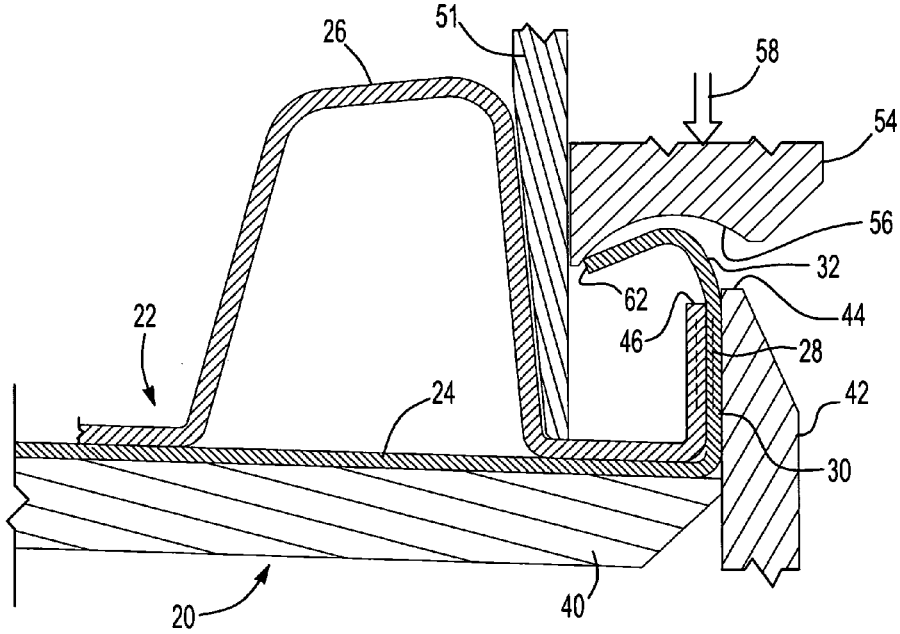
FIG. 4 is a view similar to FIG. 3, but illustrating the completion of the prehemming operation.

With reference now to FIG. 4, FIG. 4 depicts the completion of the prehemming operation. At this time, the coupon 32 is bent in a direction transverse to the original plane 30 of the outer panel outer edge portion 28 and so that the coupon 32 overlies the free edge 46 of the inner panel 26. Furthermore, during the entire prehemming operation, the anvil 42 supports the outer edge portion 28 of the outer panel 24 against outward deflection.

Figure 5:
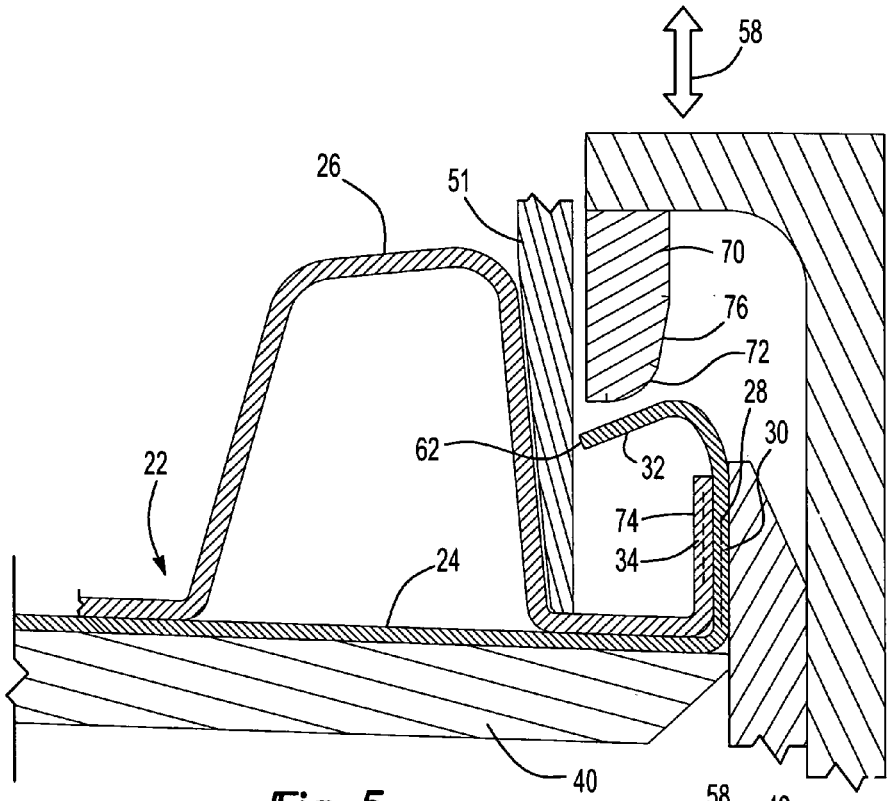
FIG. 5 is a view similar to FIG. 1, but illustrating the initiation of a final hemming operation.

With reference now to FIG. 5, the initiation of the final hemming operation is illustrated. At this time, the prehemming tool 54 (FIG. 4) has been moved out of alignment with the coupon 32 and, instead, a final hemming tool 70 is positioned such that the final hemming tool 70 is aligned with the coupon 32 and also such that the final hemming tool 70 is positioned wholly on an inside surface 74 of the inner panel outer edge portion 34.

Figure 10:
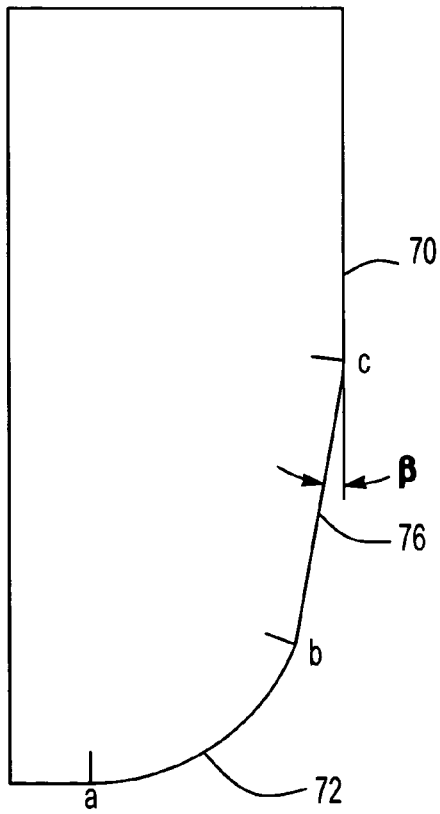
FIG. 10 is an enlarged view illustrating the final hemming tool.
Figure 11:
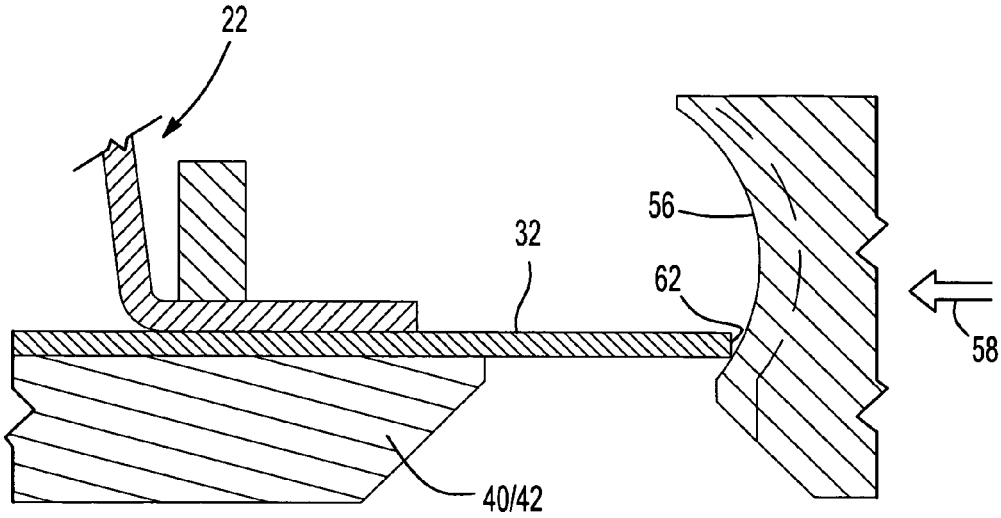
FIG. 11 is a view similar to FIG. 1, but illustrating a prehemming operation with a different body panel assembly.

With reference now particularly to FIG. 10, the final hemming tool 70 is there shown in greater detail. The final hemming tool includes a first curvilinear portion 72 extending between points a and b on the final hemming tool 70. A generally planar wedge surface 76 is then formed on the final hemming tool 70 immediately adjacent the curvilinear portion 72 and between points b and c as depicted in FIG. 10.

Alternatively, the wedge surface 76 may be formed with a large radius of curvature. Additionally, the final hemming tool 70 is radiused at points b and c to provide a smooth transition during the hemming operation.

Referring again to FIG. 5, the final hemming tool 70 and nest 40 are movable relative to each other in the direction of arrow 58 which is substantially parallel to the plane 30 of the outer panel outer edge portion 28. As with the prehemming tool, it is not necessary for the final hemming tool 70 to move in a direction 58 precisely parallel with the plane 30 of the outer panel outer edge portion 28. Rather, it is only necessary that the final hemming tool 70 and nest 40 move in the direction which is substantially parallel to the plane 30, i.e. within 15 degrees of the plane 30. Similarly, any conventional means, such as the actuator 60 (FIG. 1), may be used to move the nest 40 and final hemming tool 70 relative to each other.

Figure 6:
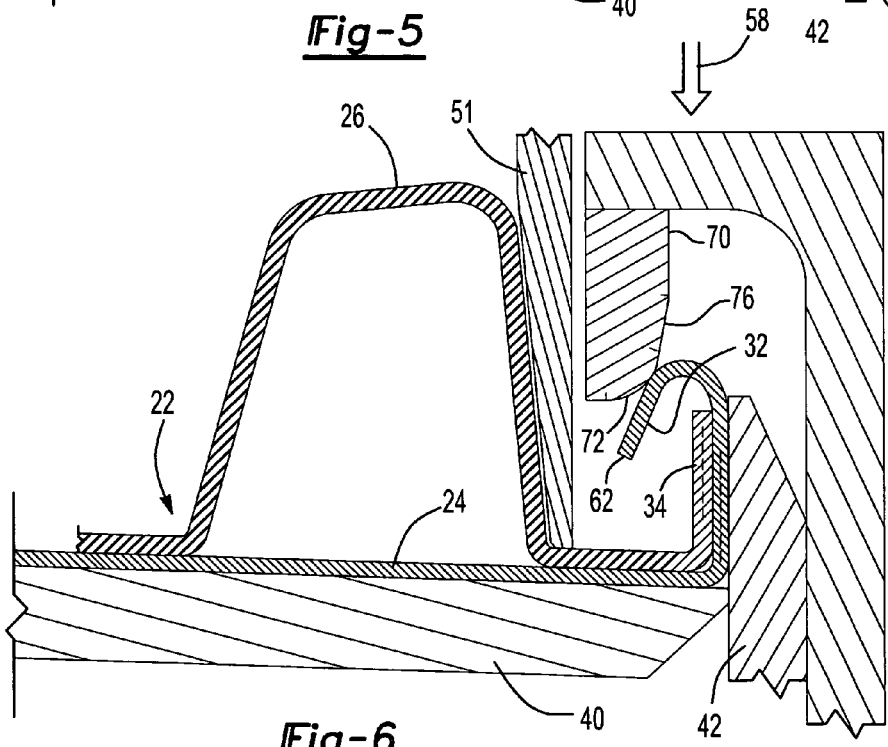
FIG. 6 is a view similar to FIG. 5, but illustrating the final hemming operation at a time subsequent to the final hemming operation depicted in FIG. 5.

With reference now to FIG. 6, during the initiation of the final hemming operation, the final hemming tool 70 and nest 40 are moved relative to each other such that the curvilinear surface 72 on the final hemming tool 70 contacts the coupon 32. Movement of the final hemming tool 70 and nest 40 relative to each other causes the coupon 32 to roll along the curvilinear surface 72 from point a to point b (FIG. 10) thus bending the free edge 62 of the coupon 32 towards the inside surface 74 of the inner panel outer edge portion 34.

Figure 7:
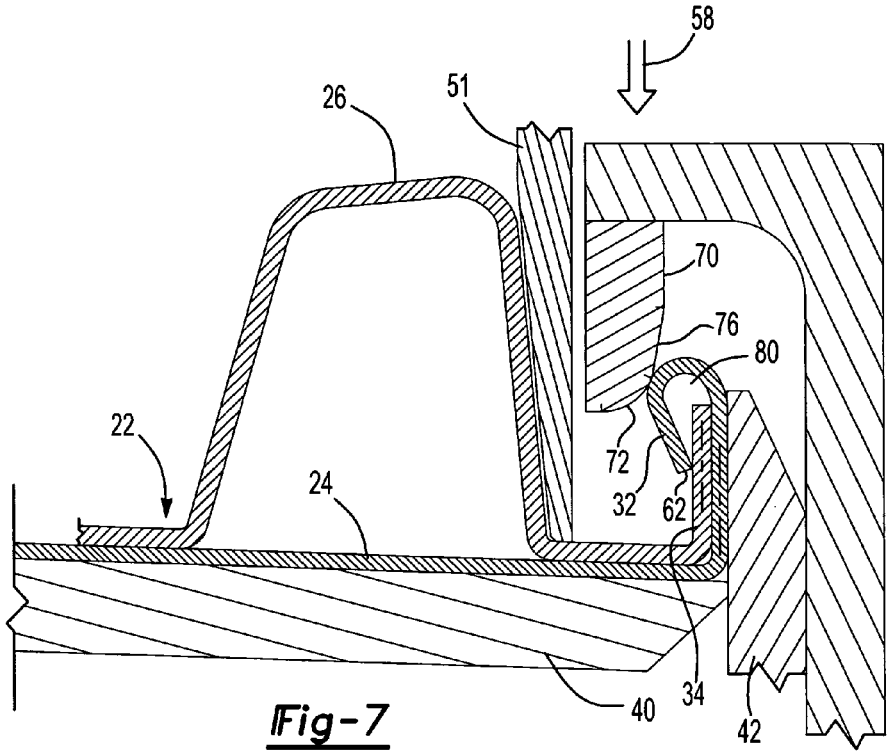
FIG. 7 is a view similar to FIG. 6, but illustrating the final hemming operation subsequent to the final hemming operation depicted in FIG. 6.

With reference now to FIG. 7, during the continued movement of the nest 40 and final hemming tool 70 toward each other, the final hemming tool 70 causes the free end 62 of the coupon 32 to abut against the inside surface 74 of the inner panel outer edge portion 34. At the time the final hemming tool 70 contacts the coupon 32 substantially at the junction between the curvilinear surface 72 and planar wedge portion 76 on the final hemming tool 70.

Figure 8:
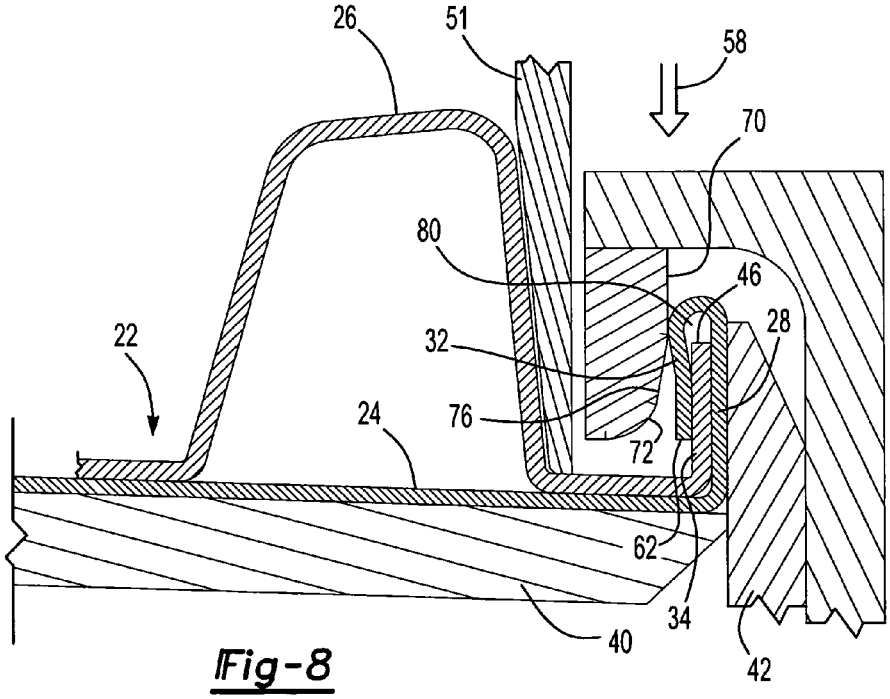
FIG. 8 is a view illustrating the completion of the final hemming operation.

With reference now to FIG. 8, the final hemming tool 70 is there shown in the final hemming position relative to the nest 40. As the final hemming tool 70 moves from the position shown in FIG. 7 and to the final position shown in FIG. 8, a sliding contact is formed between the planar wedge surface 76 on the final hemming tool 70 and the coupon 32. This wedge surface 76 thus compresses the coupon 32 against the inner panel outer edge portion 34 and completes the hemming operation. At the completion of the hemming operation, the outer edge portion 34 of the inner body panel 26 is sandwiched in between the coupon 32 and the outer edge portion 28 of the outer body panel 24. Furthermore, during this compression, the anvil 42 supports the outer edge portions 28 and 34 of the body panels 24 and 26, respectively, against outward deflection.

Still referring to FIG. 8, a gap 80 is formed between the free edge 46 of the inner body panel 26 and the now bent end of the coupon 32. Furthermore, during the entire hemming operation, no axial force is imposed on the outer edge portion 34 of the inner body panel 26, thus eliminating any possible distortion from any such axial force.

Figure 12:
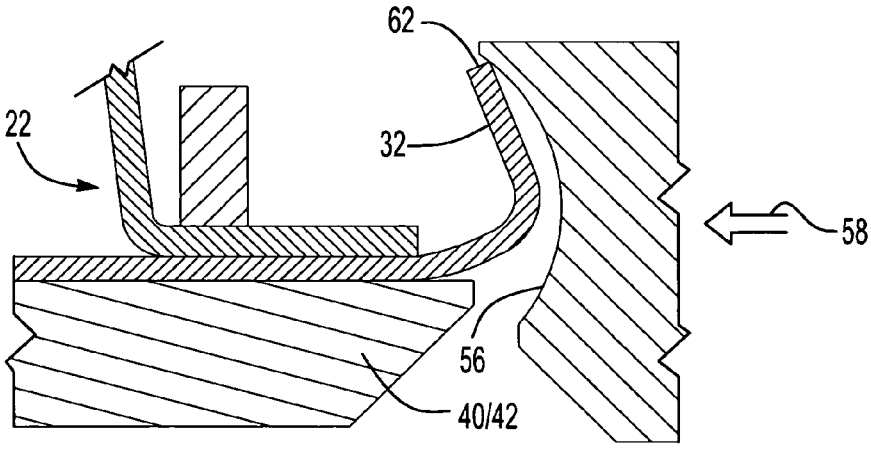
FIG. 12 is a view similar to FIG. 3, but illustrating the completion of the prehemming operation with the body panel assembly of FIG. 11.
Figure 13:
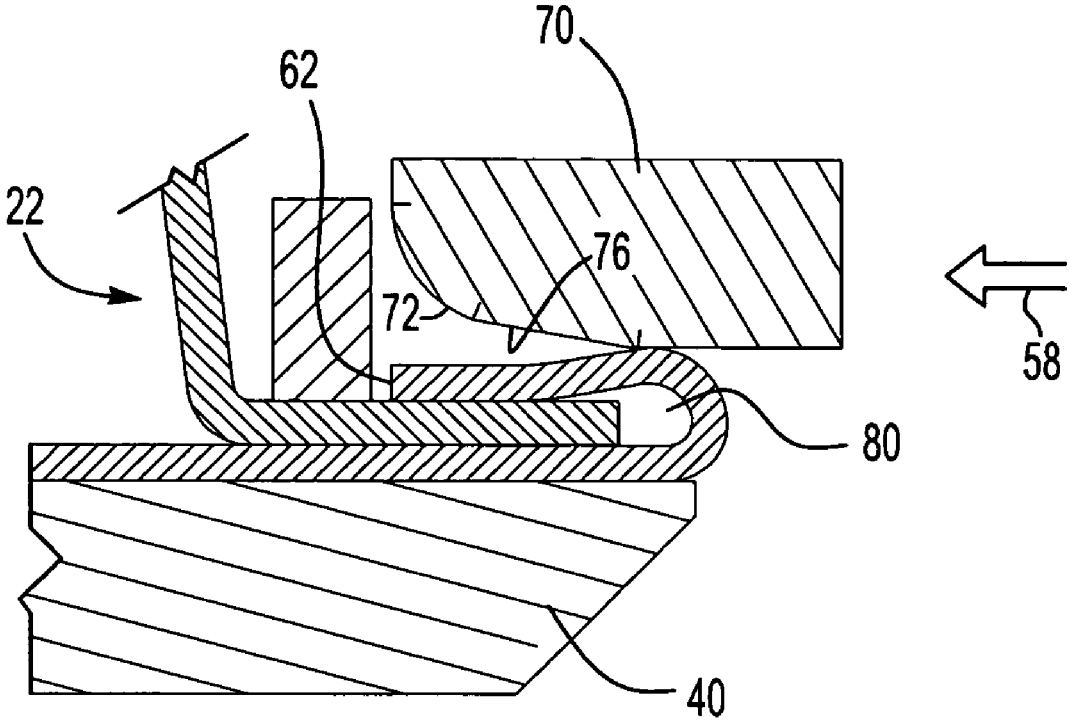
FIG. 13 is a view similar to FIG. 8, but illustrating the completion of the final hemming operation with the body panel assembly of FIG. 11.

With reference now to FIGS. 12 and 13, a prehemming operation is illustrated in FIG. 12 and a final hemming operation is illustrated in FIG. 13. The hemming operation depicted in FIGS. 12 and 13 differs from that shown in FIGS. 1–9 only in that the hemming operation is formed laterally, rather than vertically. Therefore, no further description is required.

From the foregoing, it can be seen that the present invention provides a unique hemming method, as well as a machine for performing that method, which achieves a 180 degree hem using only two hemming operations. As such, the previously known need for a flanging operation is completely avoided. Furthermore, unlike the previously known combination flanging and hemming machines, the present invention completely eliminates the imposition of longitudinal stress on the outer edge portion of the inner panel during the hemming operation, as well as the remaining stress once fully hemmed. As such, the previously known distortion of the inner and/or outer panels following the completion of the hemming operation is also eliminated.

A still further advantage of the present invention is that the hemming operations can be performed in special applications, such as a sun roof or moon roof panel of an automotive vehicle, where conventional hemming methods and conventional hemming machines operating in three stages are unable to perform the hem due to interference with the inner body panel during any such flanging operation.

Having described my invention, however, many modifications thereto will become apparent to those skilled in the art to which it pertains without deviation from the spirit of the invention as defined by the scope of the appended claims.

What is claimed is:

1. A hemming machine for hemming an inner panel and outer metal panel together in which the metal panels each include a substantially planar outer edge portion without a flange or flange break-line initially formed, said hemming machine comprising:

a frame, a nest mounted to said frame, wherein said nest supports the panels so that the outer edge portions flatly abut against each other and lie in predetermined parallel planes with the outer edge portion of the outer panel forming a coupon which protrudes outwardly from the outer edge portion of the inner panel, a prehemming tool mounted to said frame and having a curvilinear surface aligned with the coupon, said nest and said prehemming tool being movable relative to each other in a prehemming operation in a direction substantially parallel to said predetermined parallel planes between a first position in which said curvilinear surface of said prehemming tool is spaced from the coupon and a second position in which said curvilinear surface of said prehemming tool contacts the coupon and bends the coupon so that the coupon extends in a direction transverse to said predetermined parallel planes and so that the coupon overlies an outer edge of the inner panel, a final hemming tool mounted to said frame and having a work surface, said nest and said final hemming tool being movable relative to each other in a final hemming operation in a direction substantially parallel to said predetermined parallel planes between a first position in which said work surface of said final hemming tool is spaced from the coupon and a second position in which said work surface of said final hemming tool overlies the outer edge portion of the outer panel and sandwiches the coupon between the final hemming tool work surface and the outer edge portion of the inner panel and so that said coupon at the initiation of the prehemming operation, said coupon at the completion of the final hemming operation and said outer edge portion of said inner panel all lie in parallel planes and form a hem, at least one actuator for relatively moving said nest and said hemming tools between said respective first and second positions.

2. The invention as defined in claim 1 wherein said curvilinear surface has a curvature radius in the range of 3 mm<r<9 mm.

3. The invention as defined in claim 2 wherein a tangent of said curvilinear surface contacts the coupon as said prehemming tool is moved to its first position such that the attack angle between a tangent on said curvilinear surface at its attack point with the coupon and said predetermined plane is in the range of 50–70 degrees.

4. The invention as defined in claim 1 wherein said final hemming tool work surface includes a curved surface which contacts the coupon as said final hemming tool moves from said first to said second position.

5. The invention as defined in claim 4 wherein said curved surface has a radius in the range of 2 mm<r<9 mm.

6. The invention as defined in claim 1 wherein said actuator moves said nest relative to said frame.

7. The invention as defined in claim 1 wherein said final hemming tool includes a first curvilinear surface and an adjacent planar wedge surface, said curvilinear surface of said final hemming tool contacting the coupon before said wedge surface during a final hemming operation.

8. The invention as defined in claim 7 wherein said planar wedge surface presents an angle β with the direction of the displacement of said nest relative to said frame, wherein β is in the range of 1 to 25 degrees.

9. A method for hemming two metal panels together, each panel having a substantially planar outer edge portion, said method comprising the steps of:

supporting said panels on a nest so that the outer edge portions of the panels flatly abut against each other and lie in parallel planes and so that the outer edge portion of one panel protrudes outwardly from the outer edge portion of the other panel and forms a coupon, moving a prehemming tool having a curvilinear surface in a direction substantially parallel to the plane of the outer edge portions so that the prehemming tool contacts and bends the coupon in a direction transverse to the plane of the outer edge portion, thereafter moving a final hemming tool in a direction substantially parallel to the plane of the outer edge portions so that the final hemming tool contacts and bends the coupon against the outer edge portion of the other panel.

10. The invention as defined in claim 9 wherein said prehemming tool moving step includes the step of creating a bend line in the coupon at a position spaced from the outer edge of said other panel.

11. The invention as defined in claim 9 wherein said final hemming tool moving step further comprises the steps of initially rolling the coupon toward the outer edge portion of said other panel and thereafter compressing the coupon against the outer edge portion of said other panel.

12. The invention as defined in claim 9 wherein said prehem and final hemming tool bend the coupon leaving a gap in between the inner edge and outer bend to prevent further axial compression and slight shifting of the inner panel, avoiding thereby any distortion of the outer panel.

13. A hemming machine for hemming an inner panel and outer metal panel together in an automotive roof opening panel in which the metal panels each include a planar outer edge portion, said hemming machine comprising:

a frame, a nest mounted to said frame, wherein said nest supports the panels so that the outer edge portions flatly abut against each other and lie in predetermined parallel planes with the outer edge portion of the outer panel forming a coupon which protrudes outwardly from the outer edge portion of the inner panel, a prehemming tool mounted to said frame and having a curvilinear surface aligned with the coupon, said nest and said prehemming tool being movable relative to each other in a prehemming operation in a direction substantially parallel to said predetermined parallel planes between a first position in which said curvilinear surface of said prehemming tool is spaced from the coupon and a second position in which said curvilinear surface of said prehemming tool contacts the coupon and bends the coupon so that the coupon extends in a direction transverse to said predetermined parallel planes and so that the coupon overlies an outer edge of the inner panel, a final hemming tool mounted to said frame and having work surface, said nest and said final hemming tool being movable relative to each other in a final hemming operation in a direction substantially parallel to said predetermined parallel planes between a first position in which said work surface of said final hemming tool is spaced from the coupon and a second position in which said work surface of said final hemming tool overlies the outer edge portion of the outer panel and sandwiches the coupon between the final hemming tool work surface and the outer edge portion of the inner panel and so that said coupon at the initiation of the prehemming operation, said coupon at the completion of the final hemming operation and said outer edge portion of said inner panel all lie in parallel planes and form a hem, at least one actuator for relatively moving said nest and said hemming tools between said respective first and second positions.

14. The invention as defined in claim 13 wherein said curvilinear surface has a curvature radius in the range of 3 mm<r<9 mm.

15. The invention as defined in claim 13 wherein a tangent of said curvilinear surface contacts the coupon as said prehemming tool is moved to its first position such that the attack angle between a tangent on said curvilinear surface at its attack point with the coupon and said predetermined plane is in the range of 50–70 degrees.

16. The invention as defined in claim 13 wherein said final hemming tool work surface includes a curved surface which contacts the coupon as said final hemming tool moves from said first to said second position.

17. The invention as defined in claim 16 wherein said curved surface has a radius in the range of 2 mm<r<9 mm.

18. The invention as defined in claim 15 wherein said actuator moves said nest relative to said frame.

19. The invention as defined in claim 15 wherein said final hemming tool includes a first curvilinear surface and an adjacent planar wedge surface, said curvilinear surface of said final hemming tool contacting the coupon before said wedge surface during a final hemming operation.

20. The invention as defined in claim 19 wherein said planar wedge surface presents an angle β in the direction of the displacement of said nest relative to said frame, wherein β is in the range of 1 to 25 degrees.

* * * * *